United States Patent [19]

McFarlane

[11] Patent Number: 4,561,885

[45] Date of Patent: Dec. 31, 1985

[54] PRODUCTION OF REFRACTORY MATERIALS

[76] Inventor: Norris B. McFarlane, P.O. Box 130, Charleston, S.C. 29402

[21] Appl. No.: 695,163

[22] Filed: Jan. 25, 1985

[51] Int. Cl.[4] ..... C22B 7/00

[52] U.S. Cl. ..... 75/30; 75/46; 75/63; 75/65 R

[58] Field of Search ..... 75/30, 46, 63, 65 R

[56] References Cited

U.S. PATENT DOCUMENTS

| | | | |
|---|---|---|---|
| 127,699 | 6/1872 | Luckenbach . | |
| 308,984 | 12/1884 | Pochin . | |
| 1,437,584 | 12/1922 | Clapp . | |
| 1,911,189 | 5/1933 | Harris . | |
| 2,175,281 | 10/1939 | Heskett . | |
| 2,792,311 | 5/1957 | Davies . | |
| 2,809,126 | 10/1957 | Murphy et al. . | |
| 3,417,808 | 12/1968 | Rosenberg | 75/65 R |
| 3,775,091 | 11/1973 | Clites et al. . | |

*Primary Examiner*—Peter D. Rosenberg
*Attorney, Agent, or Firm*—Luke J. Wilburn, Jr.

[57] ABSTRACT

A method of producing an economical refractory material from the slag by-product of a high-carbon ferrochromium ore smelting process wherein the slag by-product is a fused material in solid particulate or mass form formed of a mixture of compounds comprising principally magnesia, alumina and silica, with lesser amounts of chromic oxide and other minor oxide impurities therein. Also disclosed is a process for forming a solidified refractory lining in a high temperature materials-receiving vessel from solidified fused slag by-product of a high temperature ferrochromium ore smelting process, wherein the slag refractory lined vessel may be employed directly to receive and handle high temperature molten materials and insulate the same from damage to metal parts of the vessel, and without the need for conventional prior art refractory materials constructed therein.

12 Claims, No Drawings

PRODUCTION OF REFRACTORY MATERIALS

The present invention relates to the manufacture and use of refractory materials, and, more particularly, to a method of providing an insulating refractory lining for receiving vessels of a high carbon ferrochromium smelting process, and to slag by-products of such a process useful as refractory materials.

BACKGROUND OF THE INVENTION

Refractory materials generally consist of non-metallic ceramic substances characterized by their suitability for use as structural materials at high temperatures, usually in contact with metals, slags, glass or other corrosive materials. Refractories are classified chemically as acid, basic, or neutral, are found typically in a raw-mined, process-fired, or chemically bonded state, and may be used in mass, granular or finely divided form. Refractory materials are further variously classified according to the raw materials employed and the minerals contained therein. As such, refractories have been identified by groups as siliceous, fire clay, high-alumina, magnesium-silica, magnesia-lime, chromite, and carbon.

Chrome ore, or chromitite, containing chromite and other gange materials is typically used as a refractory in a raw state in granular form as ground in open-hearth front wall maintenance, or for reheating-furnace hearths and open-hearth doors in plasticized form. Certain chrome ore refractories are described and disclosed in the following U.S. Pat. Nos.: 308.932, 1,437,584, 1,911,189, 2,792,311, 2,809,126.

Refractories are widely employed in iron and steel making operations as insulation in furnaces, flues, stacks, as runners, and as linings of ladles, pots, crucibles, and other high temperature material-receiving vessels. A detailed discussion of such refractory materials, their compositions, classifications, and uses is found in a 1971 U.S. Steel book entitled *The Making, Shaping and Treating of Steel.*

In addition to iron and steelmaking, refractories are also employed in other related high temperature processing operations, such as in the electric smelting process for production of chromium alloys of high and low carbon ferrochromium. Ferrochromium is the principal alloy used in the production of cast irons, stainless steel and other specialty steels. Chromitite, the only commercial ore of chromium, is a material in which iron oxide and chromium oxide exist in a combined form. The mineral chromite ($FeCr_2O_4$) has a spinel structure and exists with other gangue material in the chromitite ore. Chromite is most economically reduced by using carbon in an electric furnace to produce what is known as high-carbon ferrochromium. High-carbon ferrochromium, or charge chrome as it is also known, is made to many specifications, varying in chromium content from about 50% to 75%, in carbon content of from about 4% to 10%, and in silicon content of less than 1% to as much as about 10%. In distinction, low-carbon ferrochromium alloys generally possess a maximum carbon content of less than about 2% and are usually made by duplex or triplex processes involving de-siliconization of ferrochrome-silicon with a fluid chrome ore-lime slag.

The American ASTM specification A-101-50 characterizes high and low carbon ferrochromium by content, as follows:

| | High-carbon (%) | Low-carbon (%) |
|---|---|---|
| Cr | 60 to 75 | 65 to 75 |
| C | 4 to 6 | 2 (max) |
| Si | 3 | 1.5 |

High carbon ferrochromium manufactured by direct reduction of chromite with carbon in an electric furnace is known as submerged-arc smelting. Electrodes (usually three) are submerged in a burden consisting of one or more chromium ores, coke, and fluxes, such as quartz, kaolin, limestone, and the like. The mix is fed at the top of the furnace and around the three electrodes. In the smelting operation, the iron and chromium oxides are reduced to produce molten metal while the other gangue constituents of the ore which are lighter than the molten metal form a molten slag by-product. For proper fluidity, the slag should contain about 26 to 32% silica ($SiO_2$), and silica-containing materials generally are added to the ore mixture to provide the desired consistency. In smelting operations involving formation of slag, the burden supplied to the electric furnace is prepared using a calculated metallurgical balance to ensure that the chromitite will give the desired alloy composition and a workable slag by-product for separation.

A submerged-arc electric furnace is utilized in the manufacture of high carbon ferrochromium because of the high temperature required for the chemical reaction of carbon with chromite. The arc between the electrode, which is made up of baked coal, coke, and pitch, and the charge is buried or submerged in the burden or mix and much of the heat is generated by the resistance of the burden. Modern production furnaces are mostly three-phase, employing three electrodes in triangular formation. The molten metal and slag gather low in the furnace, perhaps four to six feet below the arc. The arc temperature is approximately 3680° C.; however, the temperature of the molten metal and slag would be lower depending on the carbon content of the high-carbon ferrochromium, as indicated in the following table:

STABILITY RANGES FOR PRODUCTS OF REDUCTION OF $Cr_2O_3$

| PRODUCT Ferrochromium | RANGE °C. | % CARBON IN |
|---|---|---|
| $Cr_7C_3$ | 1250 to 1600 | 9.0 Approximately |
| $Cr_{23}C_6$ | 1600 to 1820 | 5.5 to 6.0 |

For manufacture of ferrochromium alloys with 5.5 to 6.5% carbon content, the temperature of the metal and slag as they are tapped from the furnace ranges from 1600° to 1820° C.

The constituents of chrome ore are essentially $Cr_2O_3$, FeO, $Al_2O_3$, MgO, CaO and $SiO_2$. The valuable minerals in the chromium ore are $Cr_2O_3$ and FeO, which are reduced to chromium and iron in the electric furnace, and make up the high-carbon ferrochromium alloy sought. The $Al_2O_3$, MgO, CaO and $SiO_2$ in the chromium ore are gangue materials and form a portion of the slag in the electric furnace.

The composition of the coke is essentially carbon and ash. The carbon in the coke combines with the oxygen in the $Cr_2O_3$ and FeO, thereby freeing the FeCr. The chemical reactions are as follows:

$Cr_2O_3+3C$ $2Cr+3CO$ (Gas)

$FeO+C$ $Fe+CO$ (Gas)

The ash in the coke, usually 10 to 12%, and made up mainly of $Al_2O_3$, MgO and $SiO_2$, also forms a portion of the slag.

Fluxes, such as quartz ($SiO_2$), kaolin ($Al_2O_3$ and $SiO_2$), and limestone ($CaCO_3$), generally are added to condition the slag and give the metallurgical balance desired.

Thus, the gangue from the chromitite, the gangue from the coke (the ash), and the additional fluxes make up the molten slag composition in the electric furnace.

In the chromitite smelting operation, the smelting furnace is periodically tapped at the bottom of the burden to discharge a molten metal and slag mixture into a refractory brick-lined receiving vessel or ladle. The heavier molten metal settles to the lower portion of the receiving ladle and the lighter molten slag rises to the top, where it flows over the top of the first receiving ladle into a second vessel, generally referred to as a slag pot. This separates the slag from the molten metal alloy product. Conventionally, the molten slag by-product in the slag pot is poured into a slag pit where it solidifies and is broken up into small pieces. These slag pieces are hydraulically concentrated in a jig for further recovery of small metal alloy bits and pieces which may have been carried over into the slag during the metal/slag separation step. The final slag by-product of the high carbon ferrochromium smelting process has occasionally heretofore been further fragmentized and sold for use as a roadway aggregate, foundation fill, berme, or driveway surface.

Because of the high temperatures employed in high-carbon ferrochromium smelting, as well as steel-making and other molten ore and metal processing operations, it is a conventional practice to employ refractory materials as interior walls and insulating linings of furnaces, receiving vessels, runners, ladles, and other surfaces which contact and contain high temperature materials. Such refractory materials have generally been of the types hereinabove described, and are structurally installed in the form of bricks, blocks, or other cast shapes to line the inside of metal outer support components of furnaces, receiving vessels, ladles, and the like to protect against damage and burn-out from the high temperature materials being handled.

The installation and use of refractory materials as inner walls and linings of high temperature processing equipment adds to the initial cost of such equipment, and also creates an operating cost for inventory requirements and periodic replacement of the refractory due to degradation and wear during manufacturing operations.

BRIEF OBJECTS OF THE PRESENT INVENTION

It is an object of the present invention to provide novel and economical refractory material suitable for use in high temperature materials-handling operations.

It is another object to provide a method of lining the interior metal surfaces of high temperature material-receiving vessels with a refractory suitable to withstanding high temperature materials received therein.

It is a more specific object to provide a method of lining the interior metal surfaces of a receiving vessel of a high-carbon ferrochromium smelting process with a refractory material for use as a first receiving vessel to withstand the high temperature of materials received therein from a smelting furnace.

It is another object to provide an economical refractory material as a by-product of a high-carbon ferrochromium smelting process, which material may be employed in shaped or granular form as a refractory in iron and steel making, and in related ore smelting operations.

BRIEF SUMMARY OF THE INVENTION

The present invention is directed to the manufacture and use of the slag by-product of a high-carbon ferrochromium smelting process as a refractory material, and, in particular, to a method of providing an insulating refractory lining for the first vessel which receives molten ore and slag from the smelting furnace. The insulating refractory material of the present invention comprises the solidified fused slag by-product of a high-carbon ferrochromium smelting process. The refractory composition contains a combination of minerals formed from magnesia, alumina and silica, more specifically $MgO.Al_2O_3$ (Spinel) and $2MgO.SiO_2$ (Forsterite). The slag by-product refractory exists in solid form with a melting point of about 1650° C. or higher.

DETAILED DESCRIPTION OF THE PREFERRED EMBODIMENTS

The present invention is directed to the production of an economical refractory material suitable for use in high temperature materials-handling operations. Specifically, the refractory material is the slag by-product composition of a high-carbon ferrochromium smelting process. The slag is a fused mass containing minerals predominantly formed of magnesia, alumina and silica. These minerals exist primarily in the form of $MgO.Al_2O_3$ (Spinel) and $2MgO.SiO_2$ (Forsterite). The slag may also contain minor amounts of chromium oxide, in mineral form as $Cr_2O_3.MgO$, and small amounts of high-carbon ferrochromium metal which may not be removed from the slag in recovery of the high-carbon ferrochromium alloy.

The following table sets forth the composition of various high-carbon ferrochromium slags which might be employed and obtained in the present invention, identifying the amounts of each compound present in the slag.

| | Slag Refractory Composition | |
|---|---|---|
| | Preferred Amount (in %) | Range Amount (in %) |
| MgO | 34 | 20–45 |
| $Al_2O_3$ | 24 | 18–35 |
| $SiO_2$ | 32 | 23–43 |
| $Cr_2O_3$ | 6.0 | 2–12 |
| $TiO_2$ | 0.5 | 0.2–2.0 |
| FeO | 1.2 | 0.5–2.0 |
| CaO | 0.8 | 0.3–2.0 |
| High-carbon ferrochromium | 1.5 | 1.0–2.0 |

As stated above, certain of the above compounds do not exist in pure compound form in the slag, but in mineral form, such as $MgO.Al_2O_3$ (Spinel) and $2MgO.SiO_2$ (Forsterite). The fused minerals of magnesium aluminates spinel ($MgO.Al_2O_3$) and magnesium silcate forsterite ($2MgO.SiO_2$) have melting points of 2150° C. and 1890° C., respectively. The slag refractory material further notably exhibit little or no silica in the composition which is not bound in the mineral formation.

The fused slag refractory of the high-carbon ferrochromium smelting process may be particularly satisfactorily used to provide a refractory lining for the first receiving vessel of the ferrochromium process itself. The solidified fused slag of the present invention may be employed directly in unlined, uninsulated receiving vessels having a metal shell, without the need for the use of conventional refractory materials, such as bricks, or other shaped inserts heretofore employed in the prior art.

The method of the present invention may be illustrated by the following specific example of manufacture of refractory materials as a by-product in a high-carbon ferrochromium smelting operation. The following raw material components were combined, by metallurgical balance, as a burden for addition to an electric arc smelting furnace to produce a high-carbon ferrochromium alloy containing 5.5 to 6.0% carbon, as specified by customer requirements.

900 lbs Turkish chrome ore
100 lbs Philippine chrome ore
230 lbs coke
50 lbs kaolin ($Al_2O_3$)
50 lbs quartz ($SiO_2$)

This burden material was heated in an electric furnace containing three (3) spaced carbon electrodes buried in the burden to provide an arc temperature of approximately 3600° C. The bottom of the furnace was tapped every two (2) hours from a lower tap hole to provide a molten discharge of ferrochromium metal and slag at a temperature of approximately 1600° C. This discharge was received into a first molten material receiving ladle.

Typically, the first receiving vessel of a high-carbon ferrochromium process may be a 300 cubic foot capacity ladle having a one-inch steel plate outer shell and lined with silica brick refractory coated with a clay wash. As the first receiving ladle fills, the heavier molten ferrochromium metal gravitates to the bottom of the ladle and the lighter molten slag rises to the top to flow through a pouring spout into a second, unlined three-inch cast iron metal slag pot.

Upon completion of the tap, and separation of the molten slag from the ladle into the cast iron slag pot, the slag in the unlined slag pot is allowed to cool until a solid hardened three-inch crust or liner of slag is formed on the bare inner metal surfaces of the slag pot. Molten slag remaining in the major, central portion of the slag pot is then poured into a slag collection pit. The slag pot containing an approximate three-inch lining of solidified fused slag of a composition as set forth in the above table, is then employed as the first receiving vessel, or ladle for collection of molten metal and slag tapped directly from the electric arc furnace. The solidified slag liner serves as an effective refractory to insulate and protect the outer metal shell of the receiving vessel slag pot, such that it is unnecessary to employ refractory materials of the prior art as a liner in a first receiving vessel of the process.

The second receiving vessel, or slag pot, with slag refractory liner may also be employed as an insulated receiving vessel for collecting and separating other high temperature materials in related high temperature manufacturing operations, such as the 50% ferrosilicon, 75% ferrosilicon, ferrochrome-silicon, silicomanganese, and high-carbon ferromanganese smelting processes.

In a high-carbon ferrochromium smelting process, slag refractory linings prepared as above can be effectively economically utilized as the sole refractory material in the first receiving vessel of the process for extended periods of operation. If desired, the slag refractory may be formed as a lining in metal receiving vessel shells having smooth metal inner surfaces such that the refractory lining may be used and easily dumped from the shell after each tap, or after any number of consecutive metal taps from the furnace.

The fused slag by-products of the high-carbon ferrochromium smelting process also may be employed as a refractory material in shaped cast mass or granular form after subsequent hydraulic jig processing to remove small amounts of solid metal alloy which are carried over into the slag pit from the second slag receiving vessel. Granular processed slag from the hydraulic jig may be cast into various forms such as blocks, bricks or the like with a binder. The granular product also may be used with a binder to line or patch other high temperature material processing equipment, such as is used in the iron or steel making industry.

The refractory slag composition of the present invention, which heretofore is believed to have found only limited use as roadway, foundation fill, or driveway aggregate, can be employed as an inexpensive and economical refractory in high temperature material-handling operations. By example, assuming a useful life of a conventional refractory brick lining of a first receiving ladle of 175 taps of molten metal from the electric arc furnace, it was calculated that the prior art refractory brick installation and maintenance costs are $5.37 per net ton of ferrochromium metal alloy produced, compared to a slag refractory lining of the ladle in accordance with the present invention of $0.06 per net ton of ferrochromium metal alloy produced. Slag by-product refractory of the present invention was cast into block form and used as a furnace runner liner. Cost calculations based on the manufacture and use of the same compared with use of conventional prior art refractory lined runners were $0.05 and $0.56, per net ton of ferrochromium alloy, respectively.

That which is claimed is:

1. In a high-carbon ferrochromium smelting process in which chromitite is smelted in a smelting furnace, a mixture of molten ferrochromium metal and slag from the smelting furnace is received in a first vessel, and molten slag is removed from molten metal in the first vessel and received into a second vessel, the improvement therein comprising the steps of:

(a) retaining the molten slag in the second vessel for a sufficient time to form a non-flowable solidified lining of slag on the inside wall surfaces of the second vessel, (b) removing flowable molten slag from the central portion of the second vessel while retaining the lining of solidified slag on the inside wall surfaces thereof, and (c) thereafter employing the second vessel containing the solidified slag lining as a refractory to receive high temperature material in a high temperature processing operation.

2. A method as defined in claim 1 wherein the second vessel containing the lining of solidified slag is employed as the first vessel to directly receive a mixture of molten metal and slag from the smelting furnace of the high-carbon ferrochrome smelting process.

3. A method as defined in claim 1 wherein the second vessel is composed of an outer shell having a metal inner surface for initially receiving the molten slag therein in contact with the metal surface, and wherein the molten slag upon solidification as a lining in the shell serves as a refractory material to insulate the metal shell against burn-out and damage by contact with high temperature materials received therein.

4. A method as defined in claim 3 wherein the slag lining of the shell is at least about three inches in thickness.

5. A method as defined in claim 1 wherein the slag lining comprises fused minerals formed of compounds of magnesia, alumina, and silica.

6. A method as defined in claim 5 wherein the minerals are magnesium-aluminate spinel and forsterite.

7. A method as defined in claim 6 wherein the slag lining is formed from more than about 20% magnesia by weight of the slag composition.

8. A method as defined in claim 7 wherein the slag lining is characterized by an absence of significant amounts of silica in free form therein.

9. A method as defined in claim 1 wherein the slag lining is formed from a fused mixture of compounds comprising from about 20 to 45% magnesia, 18 to 35% alumina, and 23 to 43% silica.

10. A method as defined in claim 9 wherein the slag lining is formed of a fused mixture of compounds comprising about 34% magnesia, 24% alumina, 32% silica, and 6% chromic oxide.

11. A method of providing an insulating refractory material for receiving a high temperature material in contact therewith, comprising the steps of providing a fused solidified slag by-product composition of a high-carbon ferrochromium ore smelting process, and employing the solid slag by-product composition as a refractory receiving surface for materials which come in contact therewith.

12. A method as defined in claim 11 wherein the slag by-product composition is formed from a mixture of compounds comprising from about 20 to 45% magnesia, 18 to 35% alumina, and 23 to 43% silica.

* * * * *